US011359419B2

(12) United States Patent
Anderson et al.

(10) Patent No.: US 11,359,419 B2
(45) **Date of Patent: *Jun. 14, 2022**

(54) AUTO-RACK RAILROAD CAR DOOR LOCKING ASSEMBLY SPLICE

(71) Applicant: Transportation IP Holdings, LLC, Norwalk, CT (US)

(72) Inventors: John D. Anderson, Oswego, IL (US); Walter J. Peach, Montgomery, IL (US); Edward L. Vechiola, Lombard, IL (US)

(73) Assignee: Transportation IP Holdings, LLC, Norwalk, CT (US)

( * ) Notice: Subject to any disclaimer, the term of this patent is extended or adjusted under 35 U.S.C. 154(b) by 62 days.

This patent is subject to a terminal disclaimer.

(21) Appl. No.: 16/826,085

(22) Filed: Mar. 20, 2020

(65) Prior Publication Data

US 2020/0217109 A1 Jul. 9, 2020

Related U.S. Application Data

(63) Continuation of application No. 15/656,061, filed on Jul. 21, 2017, now Pat. No. 10,655,369.

(60) Provisional application No. 62/488,255, filed on Apr. 21, 2017.

(51) Int. Cl.

| | |
|---|---|
| ***E05B 83/10*** | (2014.01) |
| ***E05C 3/00*** | (2006.01) |
| ***B61D 19/00*** | (2006.01) |
| ***B61D 3/18*** | (2006.01) |

(52) U.S. Cl.

CPC ..... *E05B 83/10* (2013.01); *B61D 19/001* (2013.01); *E05C 3/008* (2013.01); *B61D 3/187* (2013.01); *E05Y 2900/51* (2013.01)

(58) Field of Classification Search

CPC ..... E05B 83/00; E05B 83/06; E05B 83/08; E05B 83/10; E05C 3/00; E05C 3/008; E05Y 2900/00; E05Y 2900/50; E05Y 2900/51; B61D 19/00; B61D 19/001; B61D 3/00; B61D 3/18; B61D 3/187

USPC ..... 292/197

See application file for complete search history.

(56) References Cited

U.S. PATENT DOCUMENTS

| | | | | |
|---|---|---|---|---|
| 4,768,816 | A | 9/1988 | Bakula | |
| 4,844,523 | A | 7/1989 | Pastva | |
| 4,917,021 | A | 4/1990 | Murphy | |
| 5,718,466 | A * | 2/1998 | Weinerman | E05B 15/0006 292/218 |
| 6,173,475 | B1 | 1/2001 | Senn et al. | |
| 6,527,311 | B1 | 3/2003 | Burke et al. | |
| D481,295 | S | 10/2003 | Senn | |
| 6,708,625 | B1 | 3/2004 | Burke et al. | |
| D494,840 | S | 8/2004 | Senn | |

(Continued)

*Primary Examiner* — Nathan Cumar

(74) *Attorney, Agent, or Firm* — McCoy Russell LLP

(57) ABSTRACT

In various embodiments, the present disclosure provides an door locking assembly splice including an extension tube having opposing top and bottom ends, a lock rod connection assembly connected to the top end of the extension tube, a handle connection assembly connected to the extension tube between the top end and the bottom end of the extension tube, and a cam assembly connected to the bottom end of the extension tube, that enables a damaged door rod locking assembly to be easily, quickly, and efficiently repaired.

19 Claims, 8 Drawing Sheets

(56) References Cited

U.S. PATENT DOCUMENTS

| | | | | |
|---|---|---|---|---|
| 6,779,818 | B2 * | 8/2004 | Senn | E05B 83/10 292/11 |
| D495,583 | S | 9/2004 | Senn | |
| D500,411 | S | 1/2005 | Senn | |
| 6,854,775 | B2 * | 2/2005 | Senn | E05B 17/0025 292/259 R |
| D518,358 | S | 4/2006 | Senn | |
| 7,234,755 | B1 * | 6/2007 | Senn | E05B 47/026 292/DIG. 32 |
| 7,306,267 | B2 * | 12/2007 | Senn | E05C 9/08 292/218 |
| D567,065 | S | 4/2008 | Senn | |
| D570,208 | S | 6/2008 | Senn | |
| 7,497,170 | B2 * | 3/2009 | Fortuna | B61D 7/24 105/282.2 |
| 8,381,554 | B2 * | 2/2013 | Senn | E05B 67/383 70/56 |
| 8,517,436 | B2 * | 8/2013 | Senn | E05B 83/10 292/218 |

* cited by examiner

AUTO-RACK RAILROAD CAR DOOR LOCKING ASSEMBLY SPLICE

PRIORITY CLAIM

This application is a continuation of U.S. patent application Ser. No. 15/656,061 entitled "AUTO-RACK RAILROAD CAR DOOR LOCKING ASSEMBLY SPLICE", and filed on Jul. 21, 2017, which claims priority to U.S. Provisional Patent Application No. 62/488,255, filed Apr. 21, 2017, The entire contents of each of the above-identified applications are incorporated herein by reference for all purposes.

BACKGROUND

The railroad industry employs a variety of auto-rack railroad cars for transporting newly-manufactured vehicles such as automobiles, vans, and trucks. Auto-rack railroad cars, known in the railroad industry as auto-rack cars, often travel thousands of miles through varying terrain. Auto-rack cars can have one deck, and often are compartmented, having two or three decks. Each auto-rack car typically has multiple vertically extending doors at each end of the auto-rack car. Newly manufactured vehicles are loaded into and unloaded from an auto-rack car for transport by one or more persons (each sometimes called a "loader") who drive the vehicles into or out of the auto-rack car (when the respective doors are open).

For example, as shown in FIGS. 1, 2, 3, and 4, one type of known auto-rack car indicated by numeral 10 includes a frame 12 supported by trucks 14*a* and 14*b*, each of which have several wheels (such as wheel 16) configured to roll along railroad tracks 18. The frame 12 supports two opposing sidewalls 20*a* and 20*b* and a roof 22

One problem relating to certain known auto-rack cars such as auto-rack car 10 involves the doors and associated door locking assemblies of these auto-rack cars. In certain of these known auto-rack cars, each end of the auto-rack car includes two separately openable doors that are respectively hingedly connected along opposite vertical edges of a door frame. This enables the doors to swing outwardly from the transverse plane of the door frame (relative to the tracks) to provide access to the interior of the auto-rack car. In certain of these known auto-rack cars, each door includes a plurality of connected sections. Each section is hingedly attached to an adjacent section by one or more vertically extending hinges. More specifically, in many of these known auto-rack cars, each door includes a first section hingedly connected to a vertical edge of the door frame by vertically extending hinges, a second section hingedly connected to the first section by vertically extending hinges, and a third section hingedly connected to the second section by vertically extending hinges.

For example, as shown in FIGS. 1, 2, 3, and 4, known auto-rack car 10 includes a first door 40*a* hingedly connected along a first vertical edge of the door frame 30. The first door 40*a* includes: (a) a first section 42*a* hingedly connected to the first vertical edge of the door frame 30 by a plurality of vertically extending hinges (such as hinge 43*a*); (b) a second section 44*a* hingedly connected to the first section 42*a* by vertically extending hinges (such as hinge 45*a*); and (c) a third section 46*a* hingedly connected to the second section 44*a* by vertically extending hinges (such as hinge 47*a*). Known auto-rack car 10 also includes a second door 40*b* hingedly connected to a second vertical edge of door frame 30. The second door 40*b* includes: (a) a first section 42*b* hingedly connected to the second vertical edge of the door frame 30 by vertically extending hinges (such as hinge 43*b*); (b) a second section 44*b* hingedly connected to the first section 42*b* by vertically extending hinges (such as hinge 45*b*); and (c) a third section 46*b* hingedly connected to the second section 44*b* by vertically extending hinges (such as hinge 47*b*).

In certain of these known auto-rack cars, each end of the auto-rack car also includes multiple door locking assemblies for each door. More specifically, in certain of these known auto-rack cars, two vertically extending door rod locking assemblies are attached to each door (including a first or outer door rod locking assembly and a second or inner door locking assembly). Other such known auto-rack cars only include a single (inner) door locking assembly attached to each door. Each door rod locking assembly includes an elongated lock rod rotatably attached to an exterior side of the respective section of the door by a plurality of vertically spaced apart brackets. The lock rod is rotatable about a vertically extending axis that is slightly spaced from the outer surface of the door to facilitate rotation of the lock rod. Each door rod locking assembly also includes a handle attached to and extending transversely from the lock rod to facilitate selective rotation of the lock rod.

For example, as shown in FIGS. 1, 2, 3, and 4, known auto-rack car 10 includes: (a) an outer door rod locking assembly 50*a* rotatably connected to the first section 42*a* of door 40*a*; (b) an inner door locking assembly 70*a* connected to the second section 44*a* of door 40*a*; (c) an outer door rod locking assembly 50*b* rotatably connected to the first section 42*b* of door 40*b*; and (d) an inner door locking assembly 70*b* connected to the second section 44*b* of door 40*b*. The outer door rod locking assembly 50*a* includes a relatively short lock rod 52*a* and a handle 54*a* attached to and extending radially from the lock rod 52*a*. The inner door locking assembly 70*a* includes a relatively long lock rod 72*a* and a handle 74*a* attached to and extending transversely from the lock rod 72*a*. The outer door rod locking assembly 50*b* includes a relatively short lock rod 52*b* and a handle 54*b* attached to and extending transversely from the lock rod 52*b*. The inner door locking assembly 70*b* includes a relatively long lock rod 72*b* and a handle 74*b* attached to and extending transversely from the lock rod 72*b*.

In certain of these known auto-rack cars, certain of the door rod locking assemblies include an upper cam structure including an upper locking tongue or finger that transversely extends from the lock rod. Upon suitable rotation of the lock rod, the upper locking tongue of the upper cam structure coacts with an upper tongue receiver (secured at the top of the door frame) to provide a useful mechanical advantage to close the door and secure the door in the closed position. Likewise, certain of the door rod locking assemblies include a lower cam structure including a lower locking tongue or finger that transversely extends from the lock rod. Upon suitable rotation of the lock rod, the lower locking tongue of the lower cam structure coacts with a lower tongue receiver (secured at the bottom of the door frame) to provide a useful mechanical advantage to close the door and secure the door in the closed position.

For example, as shown in FIGS. 1, 2, 3, and 4, known auto-rack car 10 includes: (a) an upper cam structure 76*a* attached to the top of the lock rod 72*a*, and that includes an upper locking tongue or finger 78*a* that extends from the lock rod 72*a*; and (b) a lower cam structure 80*a* attached to the bottom of the lock rod 72*a*, and that includes an lower locking tongue or finger (not shown) that extends from the lock rod 72*a*. Known auto-rack car 10 also includes: (a) an upper cam structure 76*b* attached to the top of the lock rod 72*b*, and that includes an upper locking tongue or finger (not shown) that extends from the lock rod 72*b*; and (b) a lower cam structure (not labeled) attached to the bottom of the lock rod 72*b*, and that includes a lower locking tongue or finger (not shown) that extends from the lock rod 72*b*. FIGS. 1, 2, 3, and 4 also show certain of the upper and lower tongue receivers such as tongue receivers 81*a*, 81*b*, and 82*a*.

In certain of these known auto-rack cars, certain door rod locking assemblies only include a lower cam structure including a lower locking tongue or finger that transversely extends from the relatively short lock rod. Upon suitable rotation of the lock rod, the lower locking tongue of the lower cam structure coacts with a lower tongue receiver (secured at the bottom of the door frame) to provide a useful mechanical advantage to close the door and secure the door in the closed position.

For example, as shown in FIGS. 1, 2, and 4, known auto-rack car 10 includes: (a) a lower cam structure 58*a* attached to the bottom of the lock rod 52*a*, and that includes a lower locking tongue or finger (not shown) that extends from the lock rod 52*a*; and (b) a lower cam structure (not labeled) attached to the bottom of the lock rod 52*b*, and that includes an lower locking tongue or finger (not shown) that extends from the lock rod 52*b*. FIGS. 1, 2, 3, and 4 also show lower tongue receivers such as lower tongue receiver 83*a*.

In certain of these known auto-rack cars, the lock rods are made of steel tubing, the handles are made of steel, the upper cams are made of steel, the lower cams are made of steel, and the tongue receivers are made of steel.

During use or operation of certain such known auto-rack cars, such locking assemblies are sometimes subjected to various damaging impacts or forces. For example, during the coupling process for two such known adjacent auto-rack cars, one or more of the opposing respective couplers (such as coupler 90 shown in FIGS. 1, 2, and 4) of the two adjacent auto-rack cars that are being connected may not be aligned. In such situations, one or more of the couplers of the two adjacent auto-rack cars are at an offset or angled position when the auto-rack cars come together for coupling. When this happens, the offset or angled coupler of one of the auto-rack cars can engage the opposing auto-rack car (to which it is suppose to be coupled) in an undesired position. This undesired position of the coupler can cause the couple to engage the lower portion of one of the inner door rod locking assemblies. Specifically, the offset coupler (which is at approximately at the same height or level as the lower portions of the inner door rod locking assemblies 70*a* and 70*b* shown in FIGS. 1, 2, and 4) can impact and damage such lower cam structure and/or the lower portion of the lock rod of either of the inner door rod locking assemblies. For example, the lower cam structure 80*a* and/or the bottom of the lock rod 72*a* may be damaged by such an offset coupler. In such instances, such damaged components can become difficult to operate or can become inoperable such that the inner door rod locking assembly does not properly operate or operate at all. This can prevent the door from properly closing or opening, which creates various issues.

In such cases, the damaged inner door rod locking assembly cannot be easily, quickly, or efficiently repaired because the entire lock rod, lower cam, and upper cam that are formed as one integral member need to be replaced. More specifically, when this damage occurs, the damaged auto-rack car must be taken out of service and brought into repair shop. This known repair is done in a repair shop (instead of in the field or in a railroad yard) partially for safety reasons due to the height of the auto-rack car. This process takes the damaged auto-rack car out of service for repair and is thus time consuming, inefficient, and costly.

Accordingly, there is a need to solve these problems.

SUMMARY

Various embodiments of the present disclosure provide an auto-rack railroad car door locking assembly splice that solves the above problems by enabling a damaged door rod locking assembly of an auto-rack car to be easily, quickly, and efficiently repaired in the field or in a railroad yard. The present disclosure thus eliminates the need to take such damaged auto-rack cars out of service for repair in a repair shop. Various embodiments of the present disclosure provide an auto-rack railroad car door locking assembly splice that enables the easy, quick, and efficient replacement of a damaged lower cam structure and/or a damaged lower portion of the lock rod of a door rod locking assembly. The replacement of the damaged lower cam structure and/or the damaged lower portion of the lock rod of the door rod locking assembly can be performed using the door locking assembly splice of the present disclosure without the need to replace the entire door rod locking assembly. Various embodiments of the present disclosure also provide an auto-rack railroad car having one or more doors and one or more auto-rack railroad car door locking assembly splices described herein.

In various embodiment, the auto-rack door locking assembly splice of the present disclosure generally includes: (a) a hollow cylindrical extension tube having opposing top and bottom ends; (b) a lock rod connection assembly connected to the top end of the cylindrical extension tube; (c) a handle connection assembly connected to the cylindrical extension tube between the top end and the bottom end of the cylindrical extension tube; and (d) a cam assembly connected to the bottom end of the cylindrical extension tube. The lock rod connection assembly is configured to be connected to a severed lock rod such as a severed lock rod of a damaged door rod locking assembly (after the damaged lower portion of that lock rod has been removed) to enable the damaged door rod locking assembly to be easily, quickly, and efficiently repaired in the field or in a railroad yard without having to take the auto-rack car out of service and into a repair shop.

Various embodiments of the present disclosure also provide a door locking assembly splice as described herein that can be used for other shipping vehicles or containers besides auto-rack railroad cars. In various such embodiments of the present disclosure, such vehicles or containers have one or more doors and one or more door locking assembly splices described herein.

Other objects, features and advantages of the present invention will be apparent from the following detailed disclosure, taken in conjunction with the accompanying sheets of drawings, wherein like reference numerals refer to like parts.

DETAILED DESCRIPTION

Figure 1:
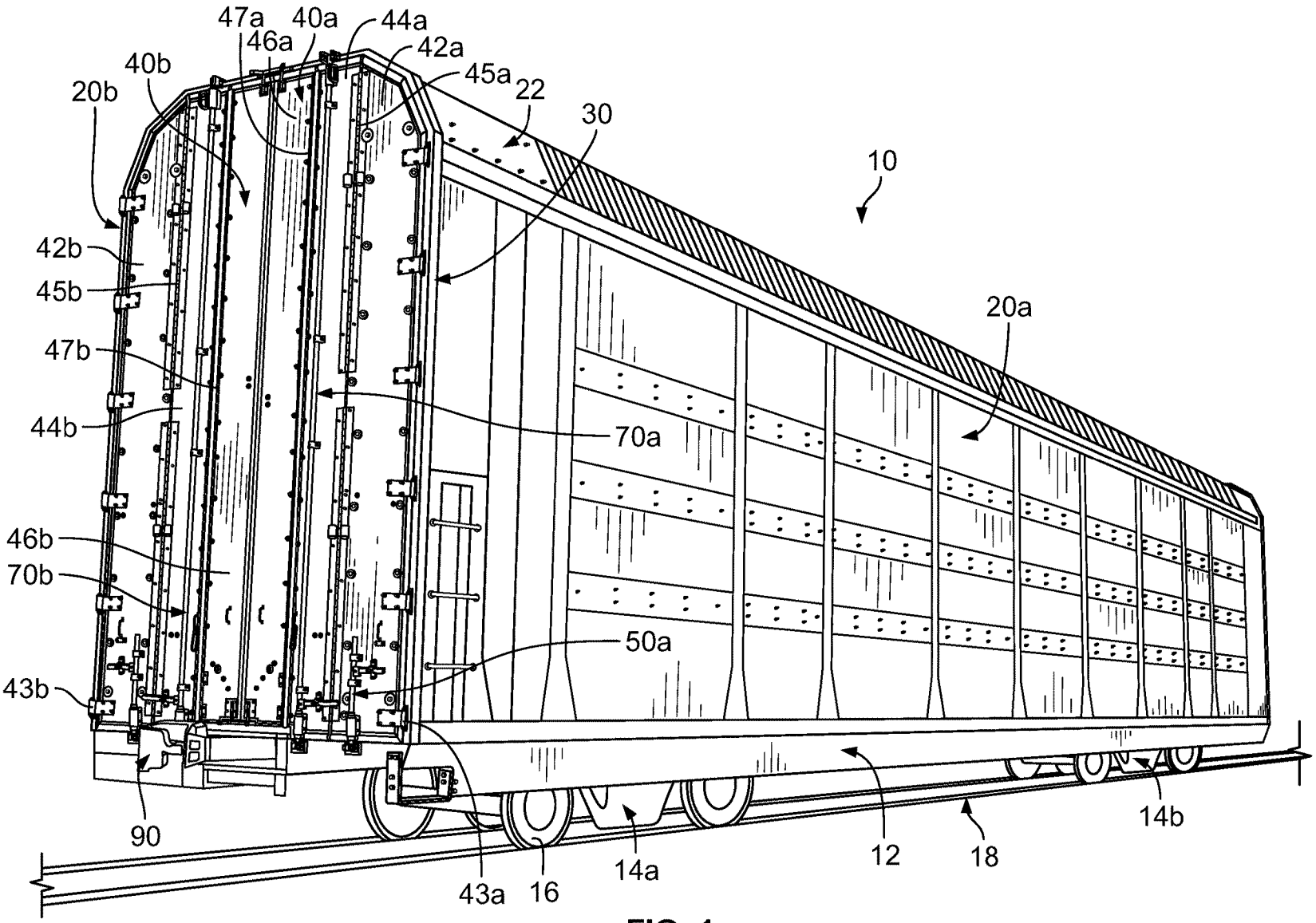
FIG. 1 is a side perspective view of one known type of auto-rack railroad car configured to transport a plurality of vehicles, and showing the doors at the end of the auto-rack railroad car and the known door rod locking assemblies.
Figure 2:
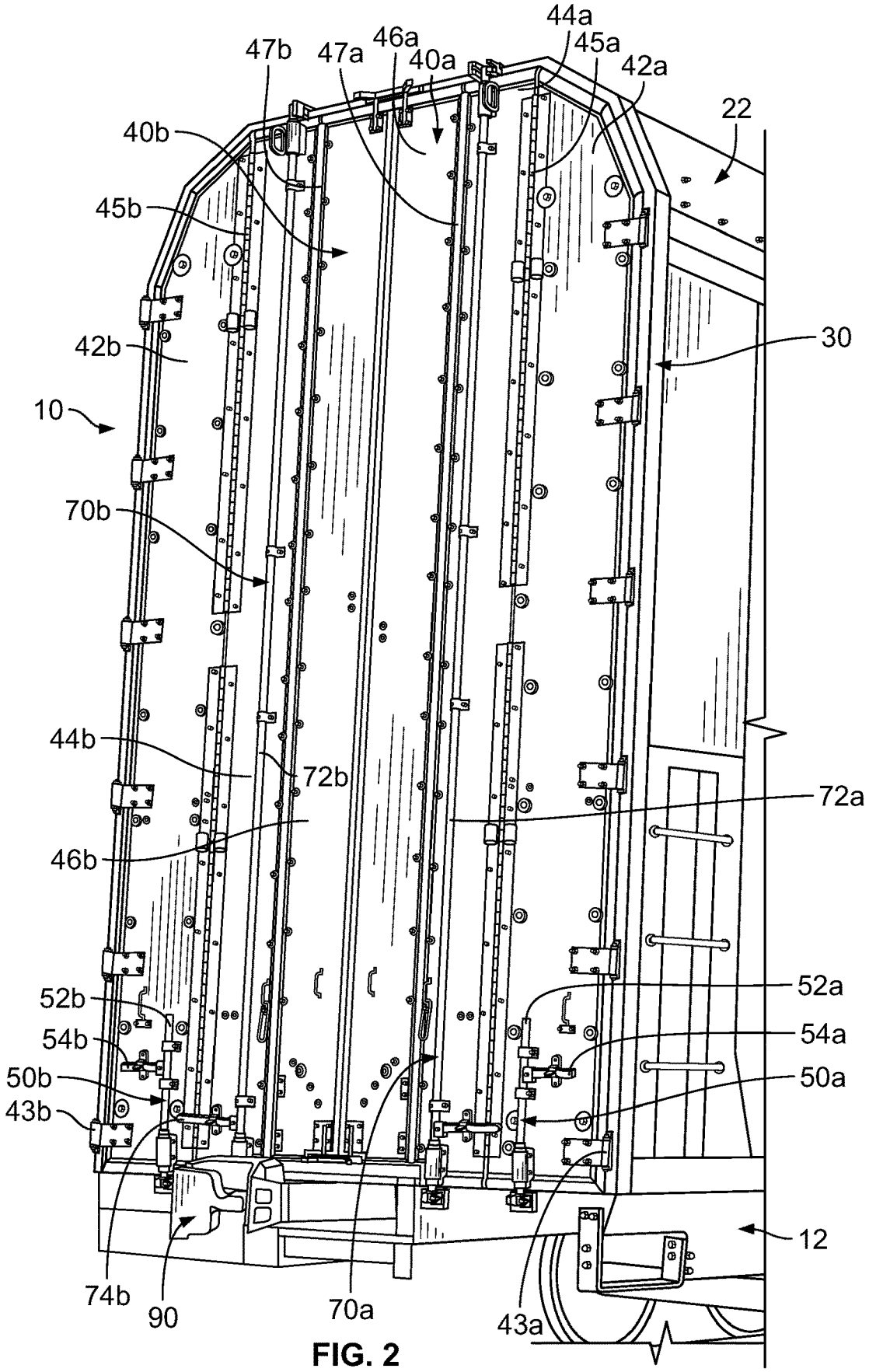
FIG. 2 is an enlarged fragmentary end perspective view of the known auto-rack railroad car of FIG. 1, and showing the doors at the end of the auto-rack car and the known door rod locking assemblies.
Figure 3:
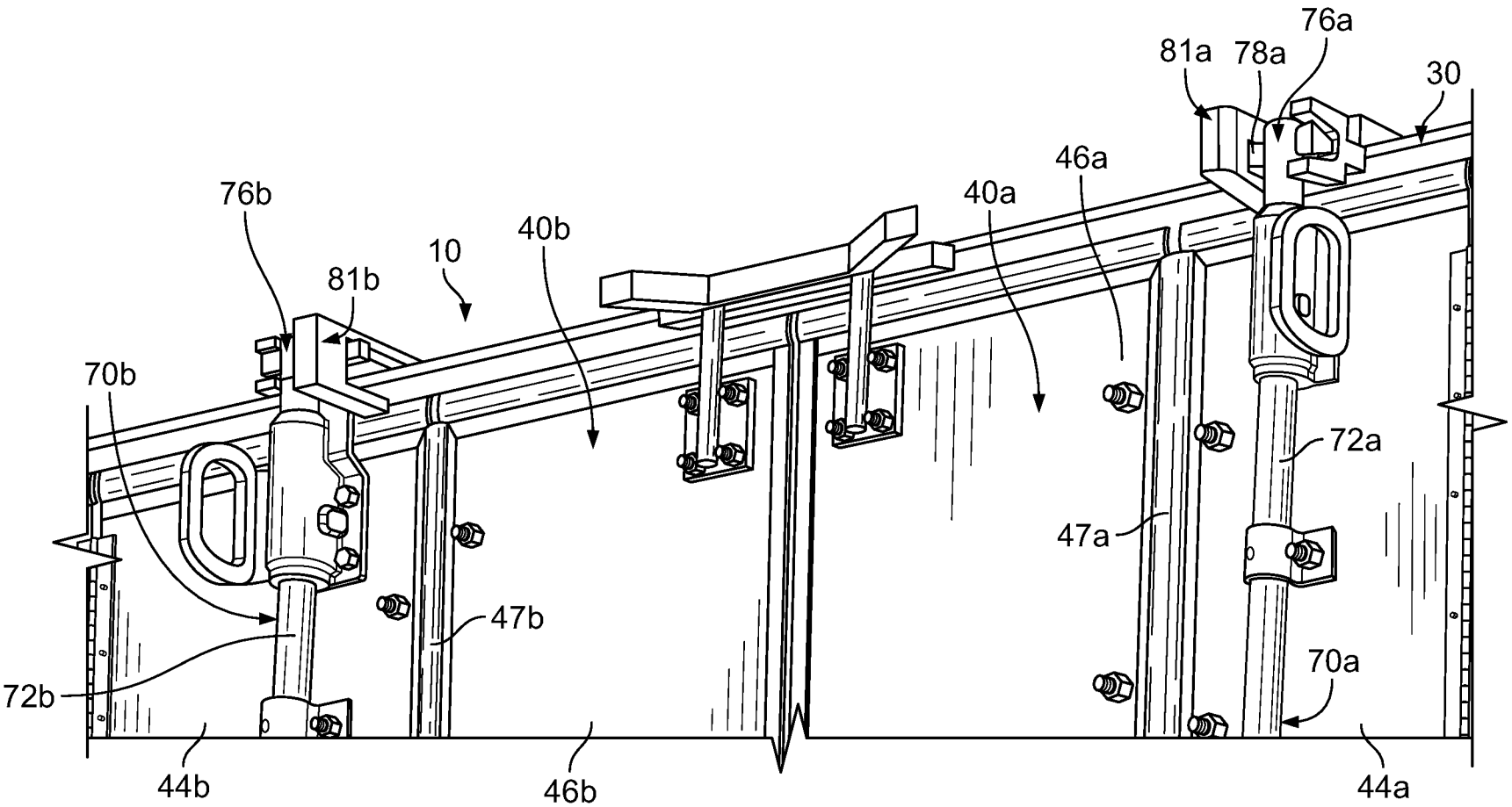
FIG. 3 is a further enlarged fragmentary end perspective view of the top of the known auto-rack railroad car of FIG. 1, and showing the top portions of the doors at the end of the auto-rack railroad car and the top portions of the known door rod locking assemblies.
Figure 4:
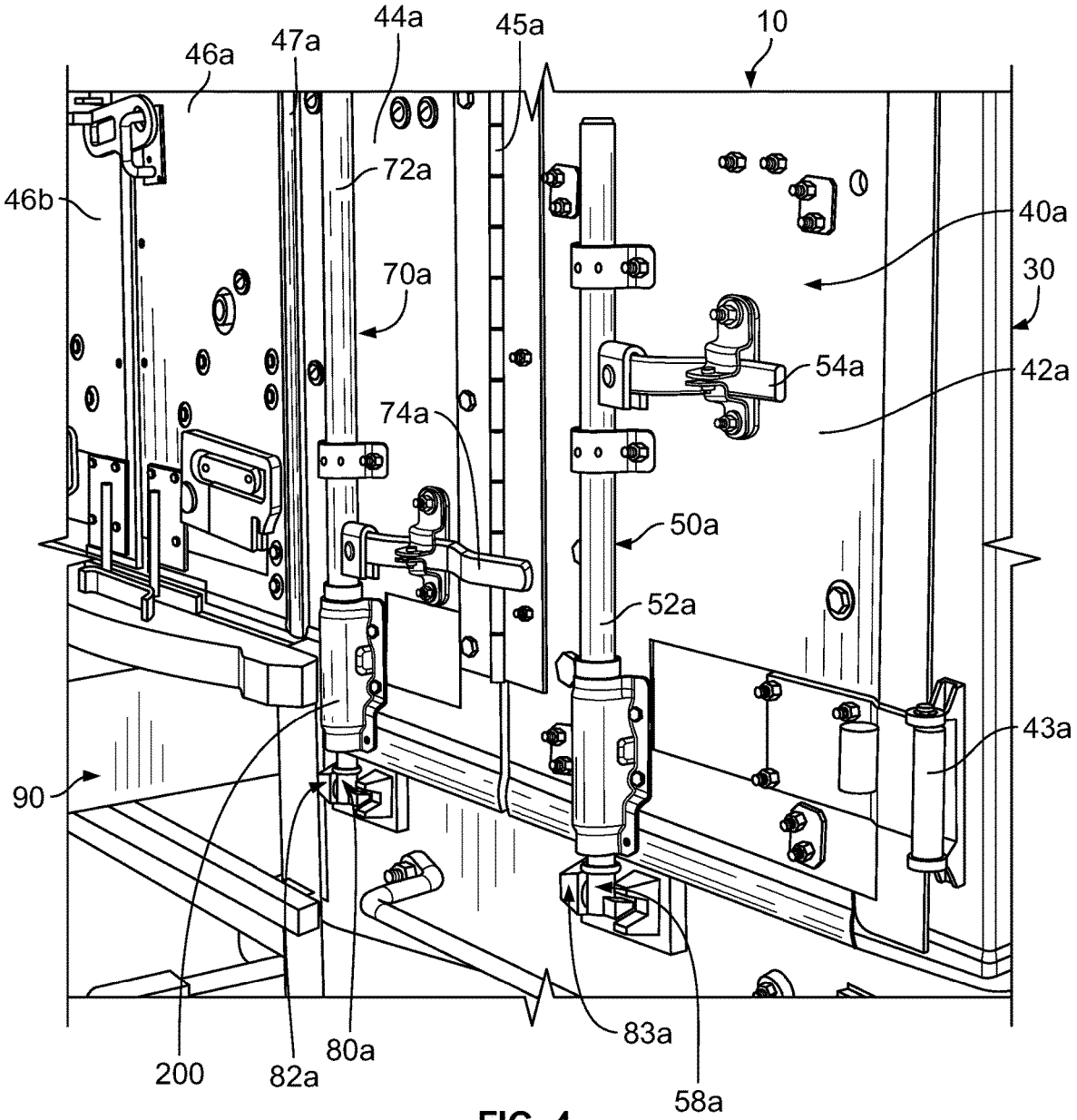
FIG. 4 is a further enlarged fragmentary end perspective view of the bottom of the known auto-rack railroad car of FIG. 1, and showing the bottom portions of the doors at the end of the auto-rack railroad car and the bottom portions of the known door rod locking assemblies.
Figure 5:
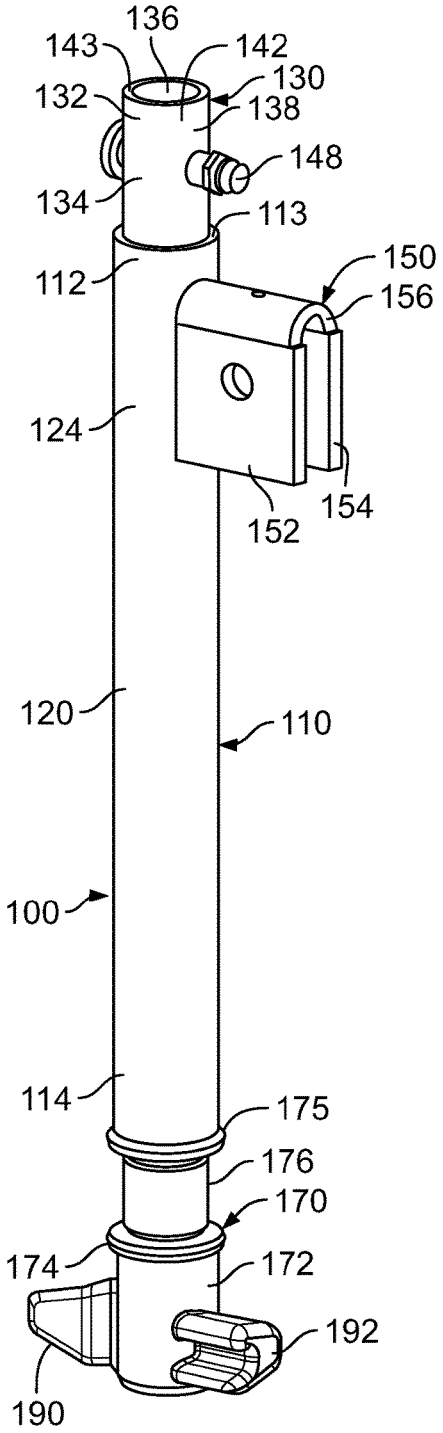
FIG. 5 is a front perspective view of the door locking assembly splice of one example embodiment of the present disclosure.
Figure 6:
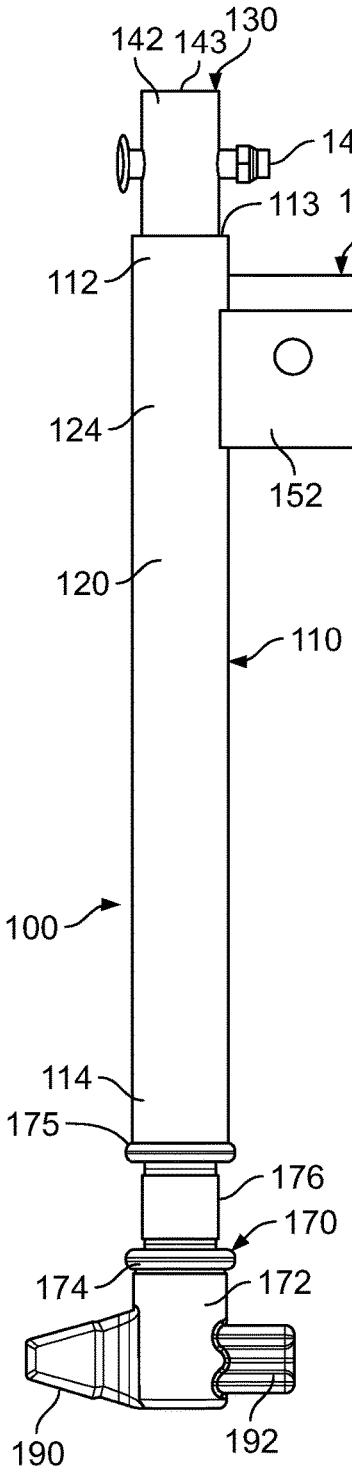
FIG. 6 is a front view of the door locking assembly splice of FIG. 5.
Figure 7:
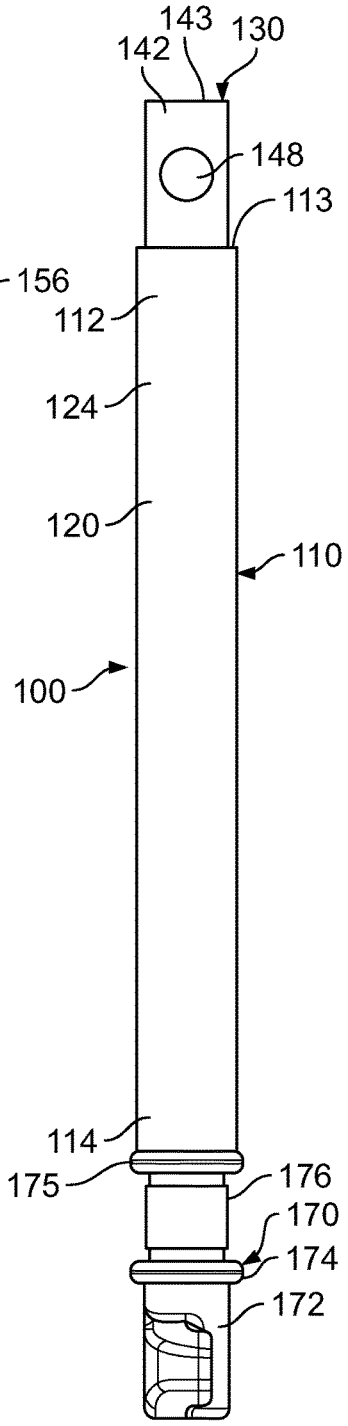
FIG. 7 is a side view of the door locking assembly splice of FIG. 5.
Figure 8:
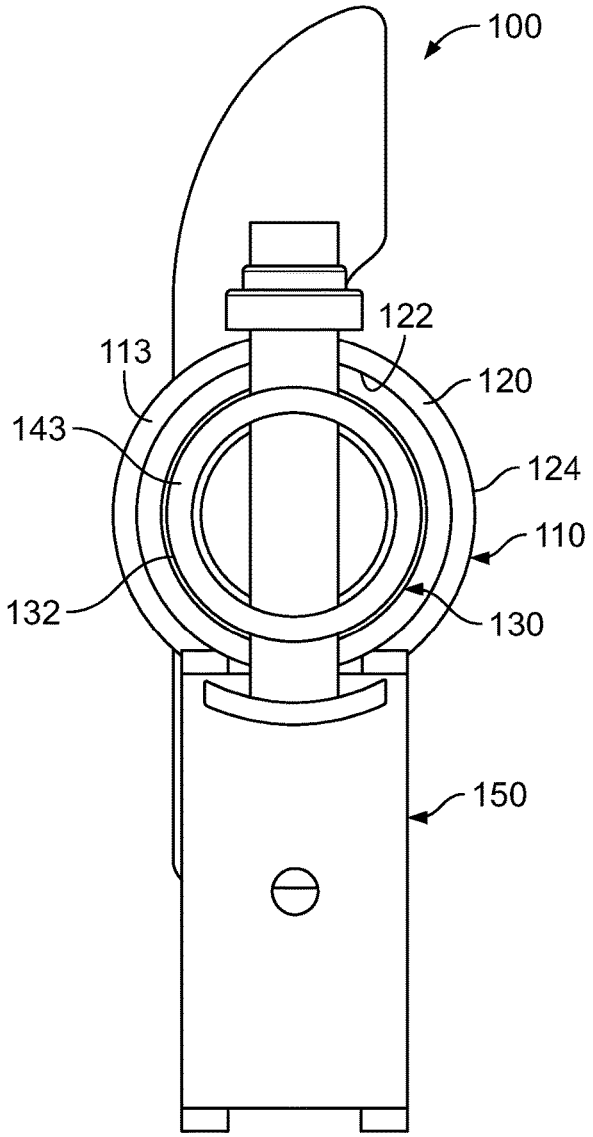
FIG. 8 is a top view of the door locking assembly splice of FIG. 5.
Figure 9:
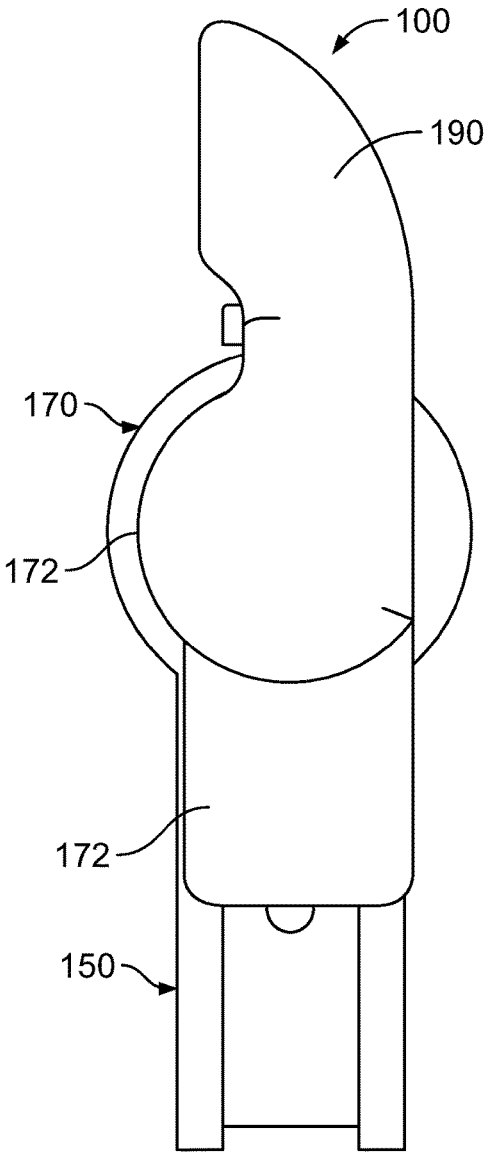
FIG. 9 is a bottom view of the door locking assembly splice of FIG. 5.

The door locking assembly splice of various embodiments of the present disclosure is illustrated in a form of an auto-rack car door locking assembly splice configured to be employed in conjunction with a known auto-rack railroad car such as the auto-rack car 10 described above and shown in FIGS. 1, 2, 3, 4, 10, and 11. It should be appreciated that the door locking assembly splice of various embodiments of the present disclosure can be employed with other railroad cars, and with other vehicles or containers.

Referring now to FIGS. 5, 6, 7, 8, 9, 10, and 11, the auto-rack door locking assembly splice of one example embodiment of the present disclosure is generally illustrated and indicated by numeral 100. This example auto-rack door locking assembly splice 100 of the present disclosure is particularly configured for auto-rack cars such as auto-rack car 10. However, it should be appreciated that the door locking assembly splice 100 can be employed in or with other devices such as other containers. The door locking assembly splice of the present disclosure may sometimes be referred to herein for brevity as the door locking assembly splice, the locking assembly splice, or the splice; however, such abbreviations are not meant to limit the present disclosure.

The illustrated example auto-rack door locking assembly splice 100 generally includes: (a) a hollow member such as extension tube 110 having opposing open top and bottom ends 112 and 114; (b) a lock rod connection assembly 130 connected to the top end 112 of the extension tube 110; and (c) a handle connection assembly 150 connected to the extension tube 110 between the top end 112 and the bottom end 114 of extension tube 110. As generally shown in FIGS. 10 and 11 and as further described below, the lock rod connection assembly 130 is configured to be connected to a free end of a severed lock rod such as lock rod **70*a* of a damaged door rod locking assembly (after the damaged portion of the lock rod 70*a* has been removed as shown in FIG. 10**) to enable the damaged door rod locking assembly to be easily, quickly, and efficiently repaired.

More specifically, in this illustrated example embodiment, the hollow extension tube or member 110 is in the form of a cylindrical tube that includes a cylindrical elongated wall 120 having an inner surface 122 defining an inner diameter of the cylindrical extension tube 110, an outer surface 124 defining an outer diameter of the cylindrical extension tube 110, a top end 112 having an upper edge 113, and a bottom end 114 having a lower edge (not labeled). In this illustrated example embodiment, the outer diameter of the extension tube 110 is the same or substantially the same as the outer diameter of the lock rod **70*a*. It should be appreciated that in other embodiments, the outer diameter of the extension tube or member 110 may vary. In this illustrated embodiment, the hollow extension tube or member 110** is made from dom steel tubing; however, it should be appreciated that it can be made from other suitable materials.

Figure 10:
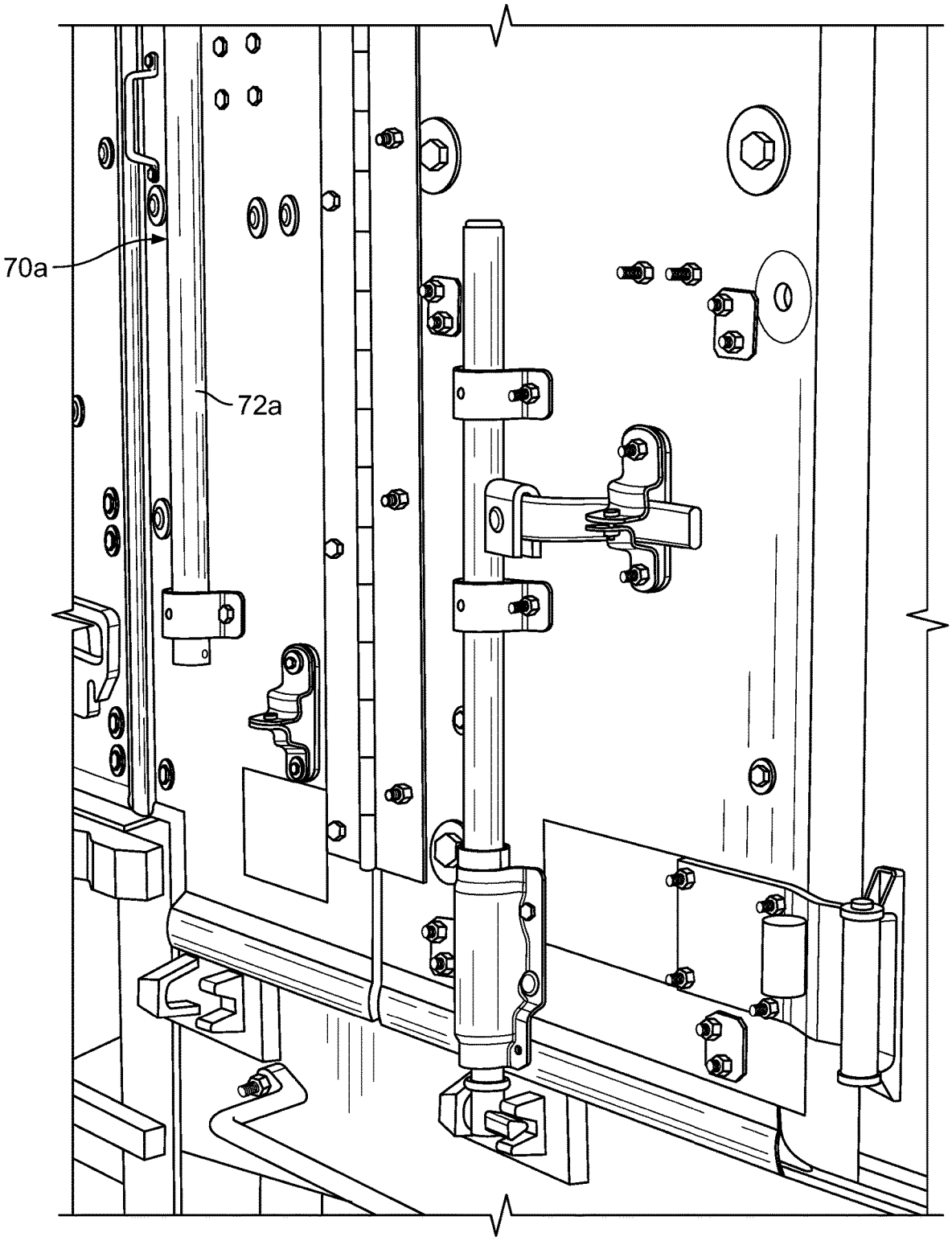
FIG. 10 is an enlarged fragmentary end perspective view of the bottom of the auto-rack railroad car of FIG. 1, showing the bottom portion of one of the inner door rod locking assemblies removed.
Figure 11:
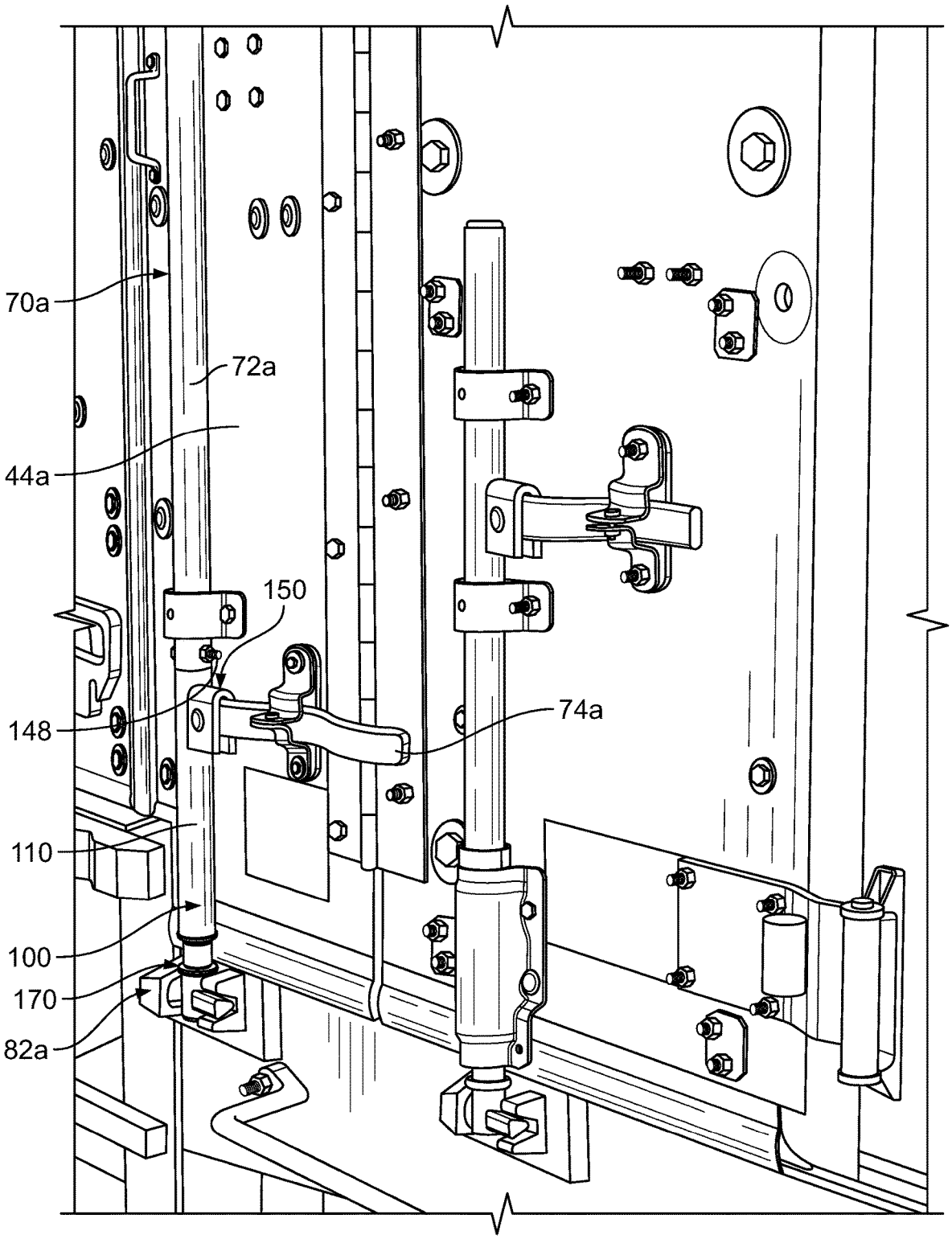
FIG. 11 is an enlarged fragmentary end perspective view of the bottom of the auto-rack railroad car of FIG. 1, showing the bottom portion of one of the inner door rod locking assemblies removed and replaced with the door locking assembly splice of FIG. 5.

In this illustrated example embodiment, the lock rod connection assembly 130 is connected or configured to be connected to the top end 112 of the cylindrical extension tube 110 and to the bottom free end of the remaining portion of the lock rod **70*a* as shown in FIGS. 10 and 11. The lock rod connection assembly 130 includes a hollow lock rod connection tube or member 132 that that includes a cylindrical elongated wall 134 having an inner surface 136 defining an inner diameter of the lock rod connection tube 132, an outer surface 138 defining an outer diameter of the lock rod connection tube 132, a top end 142 having an upper edge 143, and a bottom end (not shown) having a lower edge (not shown). In this illustrated example embodiment, the outer diameter of the lock rod connection tube 132 is smaller than the inner diameter of the extension tube 110 such that bottom end of the lock rod connection tube 132 fits into the top end 112 of the extension tube 110 as generally shown in FIGS. 5, 6, 7, 8, and 11. It should be appreciated that in other embodiments, the outer diameter of the lock rod connection tube or member 132 or parts thereof may vary. The lock rod connection tube or member 132 has or defines two spaced apart opposing fastener openings on opposite sides of the lock rod connection tube 132 between the top end 142 and the bottom end (not shown). The lock rod connection assembly 130 further includes a fastener such as fastener 148 that is configured to extend through the two spaced apart opposing fastener openings on opposite sides of the lock rod connection tube 132 and also through two spaced apart opposing fastener openings (that are drilled into opposite sides of the bottom section of the lock rod such as lock rod 70*a* a shown in FIGS. 10 and 11 as further discussed below). In this illustrated embodiment, the lock rod connection tube or member 132 is made from dom steel tubing; however, it should be appreciated that it can be made from other suitable materials. The bottom section (not shown) of the lock rod connection tube 132 is suitably connected to the top section 112 of the extension tube 110** by welding or other suitable mechanisms (not shown).

In this illustrated example embodiment, the handle connection assembly 150 is connected to or configured to be connected to the cylindrical extension tube 110 between the top end 112 and the bottom end 114 of the cylindrical extension tube 110. The handle connection assembly 150 includes two spaced apart side walls or plates 152 and 154 and an upside down U shaped connection wall or member 156. The two spaced apart side walls or plates 152 and 154 and define aligned fastener openings (not labeled) for receiving a suitable fastener (not shown in FIG. 5 or 6) that secures a handle (such as handle 74*a* shown in FIG. 11) to the handle connection assembly 150 as generally shown in FIG. 11. In this illustrated embodiment, the handle connection assembly 150 is made from steel; however, it should be appreciated that it can be made from other suitable materials. The handle connection assembly 150 is suitably connected to the extension tube or member 110 by welding or other suitable mechanisms (not shown).

In this illustrated example embodiment, the cam assembly 170 is connected or configured to be connected to the bottom end 114 of the cylindrical extension tube 110. The cam assembly 170 includes a lower cam structure including a tubular central body 172, a lower locking tongue or finger 190 connected to and transversely extending from one side of the tubular central body 172, a rear lug 192 connected to and transversely extending from the opposite side of the tubular central body 172. This lower cam structure is configured such that (after installation of the door locking assembly splice 100 as shown in FIG. 11), upon suitable rotation of the hollow extension tube or member 110, the lower locking tongue 190 coacts with a lower tongue receiver (such as tongue receiver 82*a* shown in FIG. 11) secured at the bottom of the door frame to provide a useful mechanical advantage to close the door and secure the door in the closed position. The cam assembly 170 further includes a cylindrical tube 176, a bottom collar 174, and a top collar 175 that facilitate connection to the section of the door. The cam assembly 170 further includes a cylindrical connection tube (not shown) having an outer surface defining an outer diameter of this cylindrical connection tube that is the smaller than the inner diameter of the extension tube 110 such that this cylindrical connection tube fits into the bottom end 114 of the tube 110 for attachment purposes. This configuration of the cam assembly also facilitates the attachment of the cam assembly and the entire auto-rack door locking assembly splice 100 to the door of the auto-rack car by a suitable bracket (not shown in FIG. 11). It should be appreciated that bracket 200 shown in FIGS. 1, 2, and 4 can be re-employed or re-used to attach the cam assembly and the entire auto-rack door locking assembly splice 100 to the door of the auto-rack car.

It should thus be appreciated that if a door locking assembly is bent or damaged in use or otherwise as mentioned above, the bottom part of the door locking assembly can be replaced by the door locking assembly splice of the present disclosure. In this illustrated embodiment, the following general steps are taken to replace the damaged portion of the door locking assembly such as door locking assembly 70*a*. The bottom bracket 200 (see FIG. 4) holding the bottom portion of the door locking assembly 70*a* is removed. The lock rod 72*a* is horizontally cut or severed above the damaged portion, and the damaged portion including the lower cam assembly is removed. Aligned fastener holes are drilled through the lower portion of the remaining lock rod 72*a* a designated distance slightly above the cut or the free end. The lock rod connection tube 132 of the lock rod connection assembly 130 is inserted into the open cut bottom portion or free end of the lock rod 70*a* such that the top end 112 of the extension tube 110 and particularly the top edge 113 of the tube 110 abuts or is adjacent to the bottom end or edge of the bottom portion of the lock rod 70*a* and such that the fastener holes in the lock rod connection tube 132 are aligned with the fastener holes in the lock rod 70*a*. The fastener 148 is then used to secure the lock rod connection tube 132 in the lock rod 70*a*. The bottom bracket 200 (or another bracket) is then attached to hold the bottom portion of the door locking assembly splice 100 to the door section 44*a*.

It should thus be appreciated that the combination of these components thus enables the door locking assembly to be readily and efficiently repaired without the need to replace the entire door locking assembly.

It should also be appreciated that the door locking assembly splice of the present disclosure enables the bottom portion of the locking assembly to be replaced if the bottom portion locking assembly is bent or damaged during use without having to replace the entire door locking assembly and without having to take the auto-rack car out of service for repair in a repair shop.

In an alternative embodiment that is not illustrated, the lock rod connection assembly is configured to be connected to and specifically fit over the top end 112 of the cylindrical tube 110 and/or over the bottom end of the cut lock rod 70*a*.

It should also be appreciated that the door locking assembly splice of the present disclosure can be used for a top section of a door locking assembly.

It should be understood that modifications and variations may be effected without departing from the scope of the novel concepts of the present invention, and it should be understood that this application is to be limited only by the scope of the claims.

The invention is claimed as follows:

1. A locking assembly splice connectable to a portion of a lock rod having an inner surface defining an inner passage, the splice comprising:

(a) an extension tube having opposing top and bottom ends;

(b) a lock rod connection assembly connected to the top end of the extension tube and partially insertable into the inner passage through a bottom end of the portion of the lock rod, the lock rod connection assembly including a cylindrical lock rod connection tube defining aligned spaced apart fastener openings configured to enable a fastener to be inserted through the fastener openings to connect the cylindrical lock rod connection tube to the portion of the lock rod; and (c) a cam assembly connected to the bottom end of the extension tube.

2. The locking assembly splice of claim 1, wherein the extension tube includes a cylindrical elongated wall having an inner surface defining an inner diameter of the extension tube, an outer surface defining an outer diameter of the extension tube, a top end having an upper edge, and a bottom end having a lower edge.

3. The locking assembly splice of claim 1, wherein the cylindrical lock rod connection tube includes a cylindrical elongated wall having an outer surface defining an outer diameter of the cylindrical lock rod connection tube, a top end having an upper edge, and a bottom end having a lower edge.

4. The locking assembly splice of claim 3, wherein the outer diameter of the cylindrical lock rod connection tube is smaller than the inner diameter of the extension tube such that bottom end of the lock rod connection tube fits into the top end of the extension tube.

5. The locking assembly splice of claim 1, further comprising a handle connection assembly connected to the extension tube between the top end and the bottom end of the extension tube.

6. The locking assembly splice of claim 5, wherein the handle connection assembly includes two spaced apart side walls and an upside down U shaped connection wall.

7. The locking assembly splice of claim 1, wherein the cam assembly includes a lower cam structure including a tubular central body, a lower locking tongue connected to and transversely extending from one side of the tubular central body, and a rear lug connected to and transversely extending from an opposite side of the tubular central body.

8. The locking assembly splice of claim 1, wherein the locking assembly splice is installed on a vehicle.

9. The locking assembly splice of claim 8, wherein the vehicle is a rail vehicle.

10. A locking assembly splice comprising:

(a) an extension tube having opposing top and bottom ends, the extension tube including an elongated wall having an inner surface defining an inner diameter of the extension tube, an outer surface defining an outer diameter of the extension tube, the top end having an upper edge, and the bottom end having a lower edge;

(b) a lock rod connection assembly connected to the top end of the extension tube, a top end of the lock rod connection assembly configured to be directly connected to a bottom end of a remaining portion of a lock rod;

(c) a cam assembly connected to the bottom end of the extension tube; and (d) a handle connection assembly connected to the extension tube between the top end and the bottom end of the extension tube.

11. The locking assembly splice of claim 10, wherein the lock rod connection assembly includes a cylindrical lock rod connection tube including a cylindrical elongated wall having an outer surface defining an outer diameter of the cylindrical lock rod connection tube, a top end having an upper edge, and a bottom end having a lower edge.

12. The locking assembly splice of claim 11, wherein the outer diameter of the cylindrical lock rod connection tube is smaller than the inner diameter of the extension tube such that bottom end of the lock rod connection tube fits into the top end of the extension tube.

13. The locking assembly splice of claim 10, wherein the handle connection assembly includes two spaced apart side walls and an upside down U shaped connection wall.

14. The locking assembly splice of claim 10, wherein the cam assembly includes a lower cam structure including a tubular central body, a lower locking tongue connected to and transversely extending from one side of the tubular central body, and a rear lug connected to and transversely extending from an opposite side of the tubular central body.

15. The locking assembly splice of claim 10, wherein the locking assembly splice is installed on a vehicle.

16. The locking assembly splice of claim 15, wherein the vehicle is a rail vehicle.

17. A locking assembly splice comprising:

(a) an extension tube having opposing top and bottom ends, the extension tube including a cylindrical elongated wall having an inner surface defining an inner diameter of the extension tube, an outer surface defining an outer diameter of the extension tube, the top end having an upper edge, and the bottom end having a lower edge;

(b) a lock rod connection assembly connected to the top end of the extension tube, the lock rod connection assembly including a cylindrical lock rod connection tube including a cylindrical elongated wall having an outer surface defining an outer diameter of the cylindrical lock rod connection tube, a top end having an upper edge, and a bottom end having a lower edge, the outer diameter of the cylindrical lock rod connection tube being smaller than the inner diameter of the extension tube such that bottom end of the cylindrical lock rod connection tube fits into the top end of the extension tube, a top end of the lock rod connection assembly configured to be directly connected to a bottom end of a remaining portion of a lock rod;

(c) a cam assembly connected to the bottom end of the extension tube, the cam assembly including a lower cam structure including a tubular central body, a lower locking tongue connected to and transversely extending from one side of the tubular central body, and a rear lug connected to and transversely extending from an opposite side of the tubular central body; and (d) a handle connection assembly connected to the extension tube between the top end and the bottom end of the extension tube, the handle connection assembly including two spaced apart side walls and a connection wall.

18. The locking assembly splice of claim 17, wherein the locking assembly splice is installed on a vehicle.

19. The locking assembly splice of claim 18, wherein the vehicle is a rail vehicle.

* * * * *